US006345822B1

(12) United States Patent
Reynolds

(10) Patent No.: US 6,345,822 B1
(45) Date of Patent: Feb. 12, 2002

(54) GAME APPARATUS

(75) Inventor: John Dudley Reynolds, Enfield (GB)

(73) Assignee: Mattel Europa B.V., Amstelveen (NL)

( * ) Notice: Subject to any disclaimer, the term of this patent is extended or adjusted under 35 U.S.C. 154(b) by 0 days.

(21) Appl. No.: 09/502,429

(22) Filed: Feb. 11, 2000

(51) Int. Cl.[7] ..... A63F 3/00
(52) U.S. Cl. ..... 273/281; 273/287
(58) Field of Search ..... 273/281, 287

(56) References Cited

U.S. PATENT DOCUMENTS

| | | | | |
|---|---|---|---|---|
| 2,628,838 A | | 2/1953 | Smalley | |
| 3,410,011 A | * | 11/1968 | Bowman | 273/281 |
| 3,599,977 A | * | 8/1971 | Glass | 273/281 |
| 3,888,488 A | | 6/1975 | Sims | |
| 4,136,883 A | | 1/1979 | Klees | |
| 4,773,643 A | | 9/1988 | Mizunuma | |
| 4,890,845 A | * | 1/1990 | Gatewood | 273/271 |
| 5,096,203 A | * | 3/1992 | Elstein et al. | 273/239 |

FOREIGN PATENT DOCUMENTS

| | | |
|---|---|---|
| EP | 0237118 A1 | 9/1987 |
| GB | 2233569 A | 1/1991 |
| GB | 2224946 B | 10/1992 |
| GB | 2275618 A | 9/1994 |

* cited by examiner

*Primary Examiner*—Benjamin H. Layno
(74) *Attorney, Agent, or Firm*—Kolisch Hartwell Dickinson McCormack & Heuser

(57) ABSTRACT

Game apparatus (1) has a plurality of playing locations (11) at each of which is rotatably mounted a playing piece (60). Each playing piece (60) has at least one indicium (65,66) thereon so that rotation of a playing piece (60) to a selected orientation presents said indicium (65,66) to a player. The apparatus (1) has retaining means (36) for retaining each playing piece (60) in a selected orientation. The apparatus (1) further has reset means (30) operable to reset the playing pieces (60) for a new game.

39 Claims, 5 Drawing Sheets

GAME APPARATUS

RELATED APPLICATIONS

This application claims priority under 35 U.S.C. §§ 119 and 365 to pending PCT patent application Ser. No. PCT/GB98/02420, which was filed on Aug. 11, 1998, and U.K. Patent application Ser. No. 9717202.7, which was filed on Aug. 13, 1997. The disclosures of the applications are hereby incorporated by reference.

FIELD OF THE INVENTION

The present invention relates to game apparatus.

BACKGROUND OF THE INVENTION

Various game boards are known for playing games such as draughts, Othello, and other similar games in which two or more players move tiles, counters or other playing pieces from place to place on a playing board consisting of an array of such places. Each player's tiles are usually coloured differently from those of other players. In a game such as solitaire, playing pieces of just one colour are used. In some circumstances, it is inconvenient to have playing pieces which are not somehow fixed to the board. This is particularly so where the game apparatus is to be used whilst in transit, for example during a car or train journey. In such cases, it is known to provide playing pieces having magnets and a magnetic playing board to which the pieces can be releasably fixed during play. However, such pieces are often easily lost or dislodged from their position on the board and are therefore inconvenient to use.

There have been various proposals for playing pieces which are fixed more securely to the board. In EP-A-0237118, for example, there is disclosed a games board in which playing pieces are provided by triangular prisms which can rotate in respective recesses provided in an array across the board. Each of the three square or rectangular faces of the prismatic playing pieces bears a different image representing either a first type of counter, a second type of counter, or no counter at all. The playing pieces can be rotated in their recesses selectively to display the desired counter. Each of the playing pieces in EP-A-0237118 is held in its selected orientation by a flexible resilient portion of the housing which engages an edge of the playing piece. However, this requires close manufacturing tolerances to be achieved so that not too much nor too little engagement between the playing piece and the elastic portion of the housing is achieved. Also, the elastic portions can deteriorate over time. Furthermore, there is no convenient way of resetting the playing pieces for a new game and therefore the players have the laborious task of rotating each playing piece individually to an initialised position in which the blank faces of the playing pieces all face uppermost each time a new game is to be played.

SUMMARY OF THE INVENTION

According to a first aspect of the present invention, there is provided game apparatus, the game apparatus comprising: a plurality of playing locations at each of which is rotatably mounted a playing piece, each playing piece having an indicium thereon so that rotation of a playing piece to a selected orientation presents said indicium to a player; retaining means for retaining each playing piece in a selected orientation; and, reset means operable to reset the playing pieces for a new game.

In a preferred embodiment, the center of mass of each playing piece is offset from its axis of rotation, the reset means being operable to release the retaining means from retaining the playing pieces to allow the playing pieces to rotate under gravity thereby to reset the playing pieces.

Each playing piece may have a plurality of faces, at least one of said faces having an indicium thereon to distinguish that face from other faces of the playing piece. The retaining means may comprise at least one elastic member biased into engagement with the playing pieces, the reset means being operable to disengage said at least one elastic member from the playing pieces thereby allowing the playing pieces to be reset. Said at least one elastic member preferably comprises plural spring wires which are biased into engagement with respective ones of said playing pieces. Each playing piece may have an abutment, the spring wires engaging the abutments of the respective playing pieces to retain the playing pieces in a selected orientation.

The retaining means are preferably carried by a carriage which is displaceable to allow the playing pieces to be reset. Biasing means may be provided for biasing the carriage so that the playing pieces are normally retained in a selected orientation by the retaining means, the carriage being displaceable against the bias of the biasing means to allow the playing pieces to be reset.

The apparatus may comprise a lattice grid having a plurality of walls defining the plurality of playing locations and supporting the playing pieces. The playing pieces are conveniently rotatably mounted on respective axles supported by the grid.

Each playing piece is preferably captively mounted in said apparatus. In one embodiment, each playing piece is a triangular prism having three faces selectively presentable to a player by rotation of the playing piece. A first face of each playing piece may have a first indicium thereon indicating a first game counter and a second face of each playing piece may have a second indicium thereon indicating a second counter. The face of each playing piece may bear an indicium indicating the direction of rotation of the playing piece required to present a desired first or second indicium to a player.

According to a second aspect of the present invention, there is provided game apparatus, the game apparatus comprising: a plurality of playing locations at each of which is rotatably mounted a playing piece, each playing piece having a plurality of faces, at least one of said faces of each playing piece having an indicium thereon to distinguish that face from other faces of the playing piece so that rotation of a playing piece to a selected orientation presents said indicium to a player; a carriage carrying plural spring wires which are biased into engagement with respective ones of said playing pieces for retaining each playing piece in a selected orientation; and, biasing means for biasing the carriage so that the playing pieces are normally retained in the selected orientation by the spring wires, the carriage being displaceable against the bias of the biasing means to disengage the spring wires from the playing pieces thereby to allow the playing pieces to be reset for a new game.

The center of mass of each playing piece is preferably offset from its axis of rotation in a direction opposite a predetermined face of said playing piece, the playing pieces rotating under gravity to present said predetermined faces to a player thereby to reset the playing pieces when the spring wires are disengaged from the playing pieces.

Thus, in preferred embodiments, the game apparatus of the present invention has playing pieces which may be securely fixed to the board so that there are no loose playing pieces. The playing pieces are easily reset for a new game.

For a game such as Othello, the reset position is one in which all of the playing pieces present a blank face or surface to the players, indicating an empty playing board. The movement of counters around the board is mimicked by rotating appropriate playing pieces to present an appropriate indicium to the players.

The present invention is described in more detail below in the detailed description which follows, with reference to the following drawings.

DETAILED DESCRIPTION AND BEST

Figure 1:
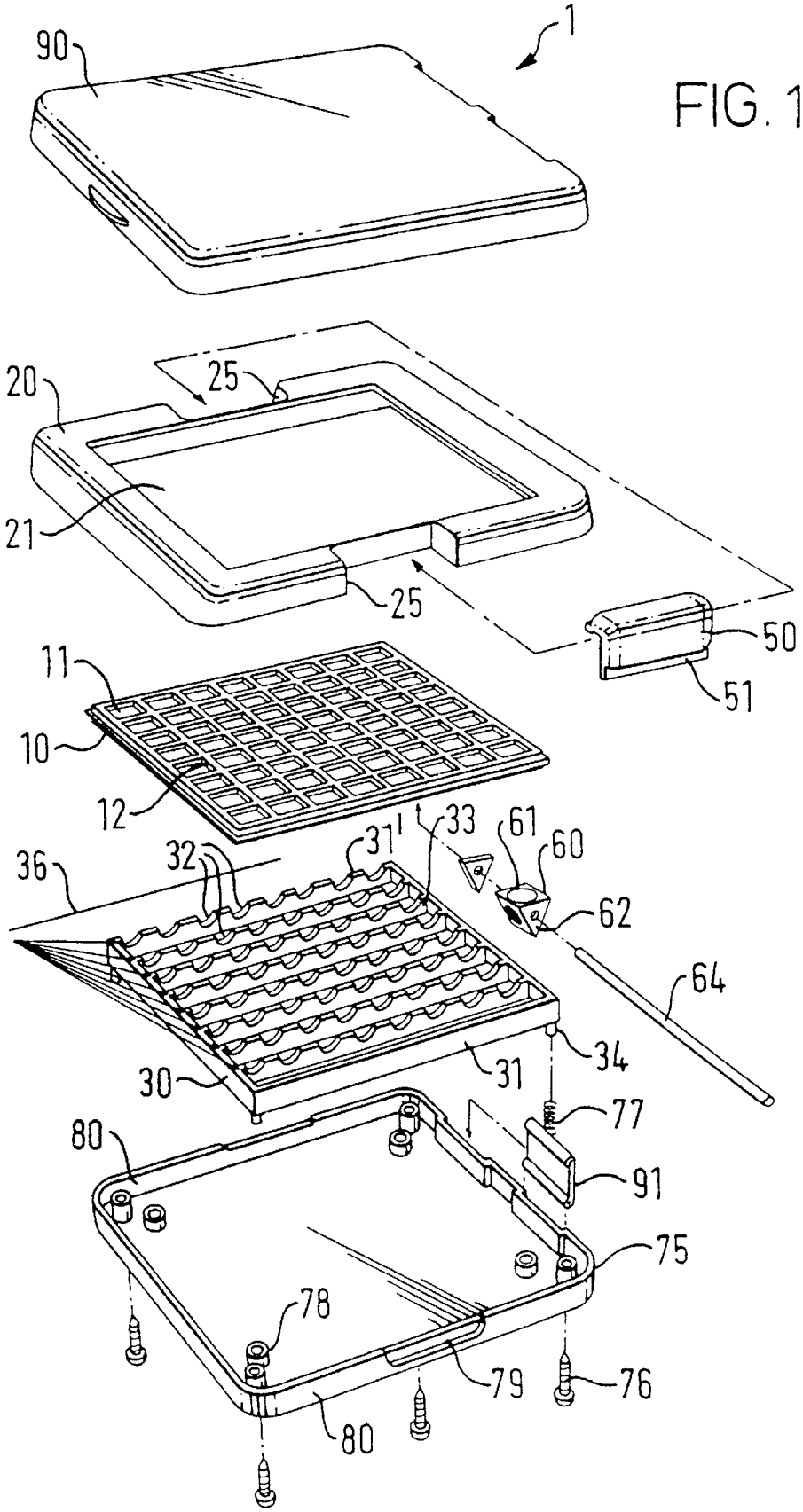
FIG. 1 is an exploded view of an example of game apparatus according to the present invention.

Referring to the drawings, there is shown an example of game apparatus 1 according to the present invention. The game apparatus 1 has a grid 10, a frame 20, a carriage 30, operating buttons 50, playing pieces 60, a bottom cover 75, and a top cover 90.

The grid 10 is in the form of a square lattice which defines a square array of eight-by-eight apertures 11 each of which is defined by first and second sets of parallel internal side walls 12,13 of the grid 10. As will be described in more detail below, a playing piece 60 is located in each of the apertures 11 of the grid 10. The playing pieces 60 can be rotated in their respective apertures 11 to present a chosen indicium to a player thereby to mimic the movement of conventional playing counters around a conventional games board as in the games of draughts, Othello, etc.

Each playing piece 60 is in the general form of a triangular prism having square side faces 61 and equilateral triangular end walls 62. Each end wall 62 has a central through hole 63 through which passes a steel axle 64 about which the playing piece 60 is able to rotate. There are eight steel axles 64 each of which carries eight playing pieces 60, each axle 64 being supported by the grid 10 as will be described further below.

The three side faces 61 of each playing piece 60 bear different indicia. In particular, a first face 61 bears a large central white circle 65. A second face 61 bears a large central black circle 66. The third face 61 does not bear any large central circle. The presence of a white counter of a first player at a particular playing location on the apparatus 1 can be indicated by rotating the playing piece 60 at that location so that the face 61 bearing the large central white circle 65 is uppermost. Similarly, the location of a black counter of another player at a particular location on the apparatus 1 can be indicated by rotating the playing piece 60 at that location so that the face 61 bearing the large central black circle 66 is presented uppermost to the players. The absence of a playing counter at particular locations is indicated by rotating each of the playing pieces 60 at those locations so as to present the face 61 having no large central circle uppermost. Preferably, the base colour of the playing pieces 60 is the same as that of the grid 10.

The playing pieces 60 are preferably further marked on their faces 61 to indicate the direction of rotation of the playing pieces 60 which is required to reveal a face bearing a desired major indicium 65,66. In particular, a plain face 61 of a playing piece 60 may bear a small white circle 67 towards one edge. Pushing the playing piece 60 on the edge indicated by the small white circle 67 will cause the playing piece 60 to rotate so that the face 61 bearing the large white circle 65 is presented to the player. A small black circle 68 is located on the opposite edge of the plain face 61 of the playing piece 60. Pressing on the edge bearing the small black circle 68 causes the playing piece 60 to rotate so that the face 61 bearing the large black circle 66 is presented to the players. The other faces 61, which bear the large white circles 65 and large black circles 66, are similarly marked with a small black circle 68 or a small white circle 67 at the edge which needs to be pushed in order to present the face bearing the large black circle 66 or large white circle 65 uppermost, as the case may be. The absence of any small white circle 67 or small black circle 68 at an edge of a face 61 indicates that pushing on that edge of the playing piece 60 will cause the plain face 61 of the playing piece 60 to be presented uppermost. These smaller indicium, including the absence thereof on a selected one of the faces, may be referred to as rotation indicium, in that they indicate the direction a player must rotate the piece to reveal, or display, a corresponding one of the other faces.

One end wall 62 of each of the playing pieces 60 has an abutment in the form of an equilateral triangular stud 69 projecting therefrom and surrounding the through hole 63. The triangular stud 69 has its own central through hole 70 through which the axle 64 passes. When the playing pieces 60 are mounted in the game apparatus 1, all of the triangular studs 69 face in the same direction.

Figure 2A:
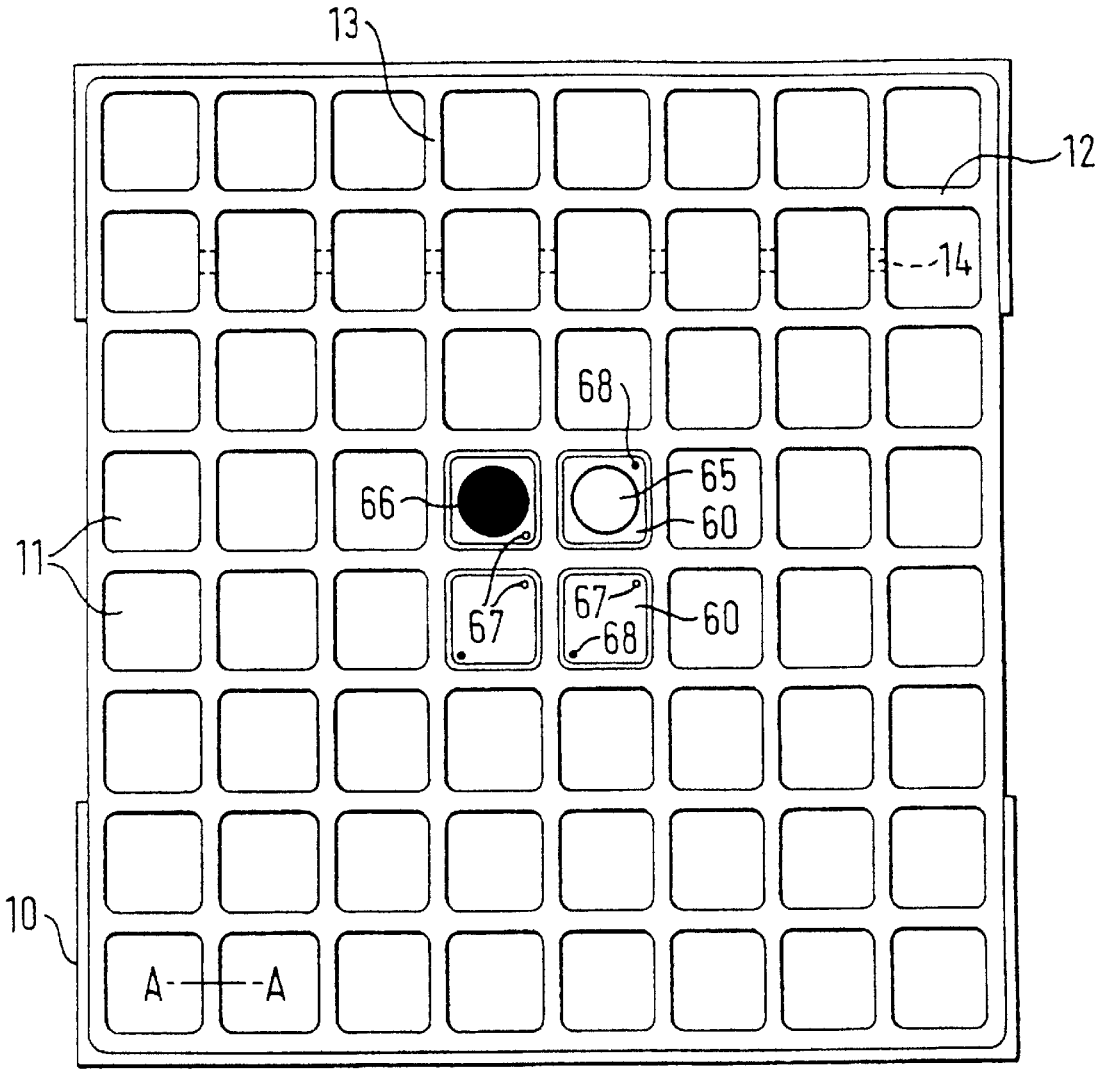
FIGS. 2A–C are respectively a plan view, a partial cross-sectional view and a partial perspective view of a top grid of the game apparatus of FIG. 1.
Figure 2B:
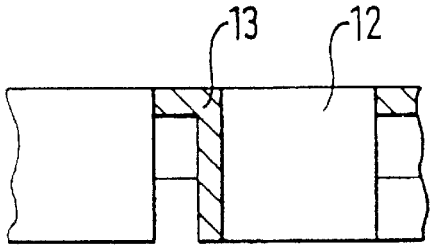
Figure 2C:
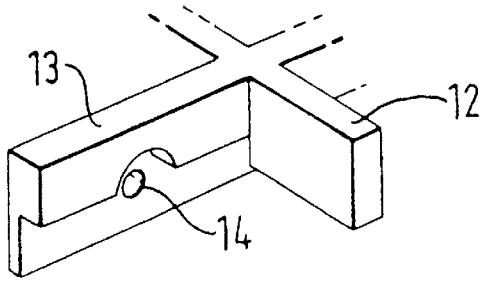
Figure 3A:
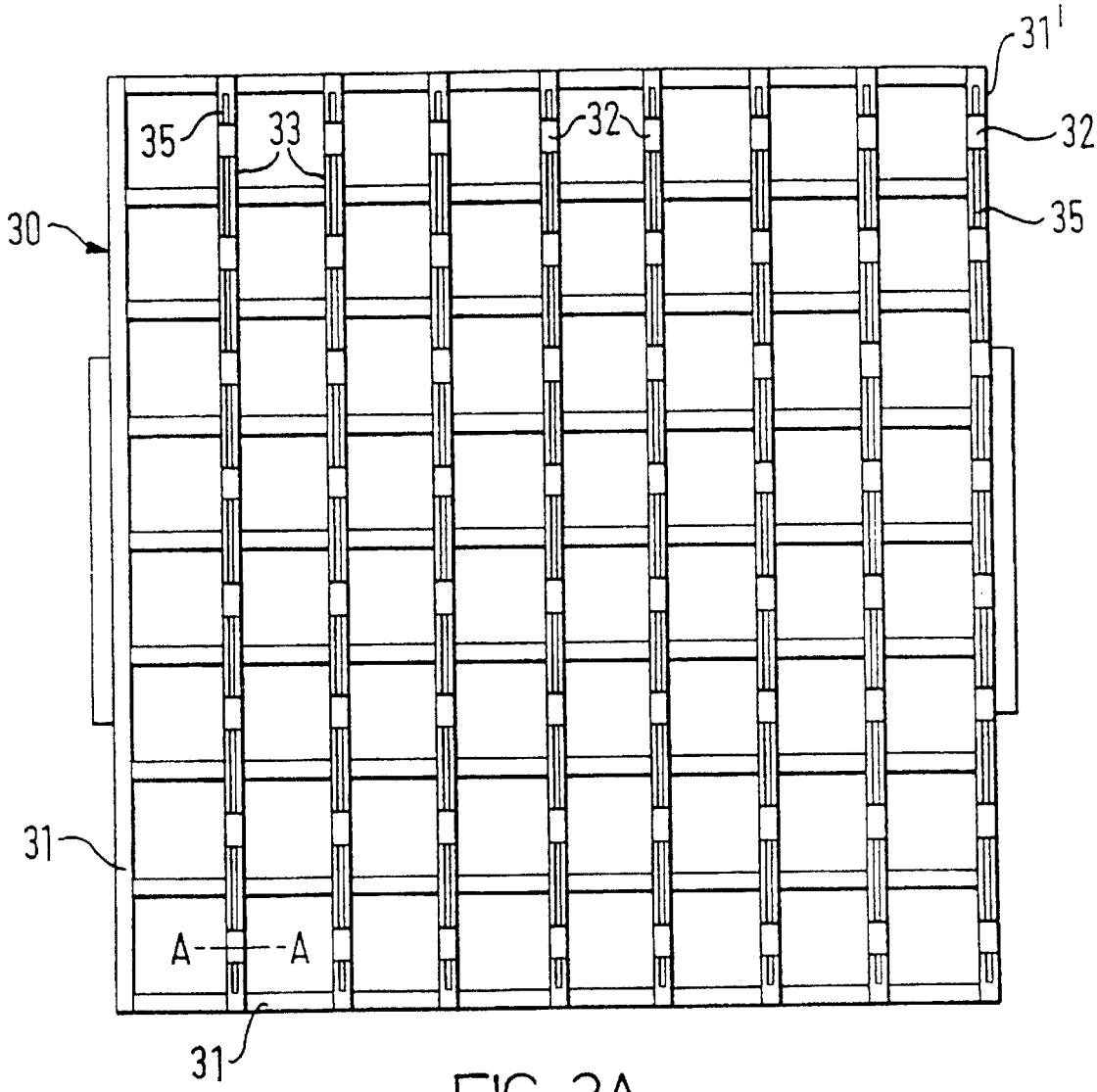
FIGS. 3A–C are respectively a plan view, a partial cross-sectional view and a partial perspective view of a carriage of the game apparatus of FIG. 1.
Figure 3B:
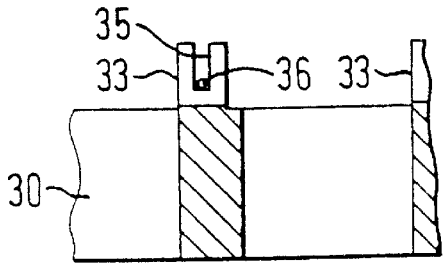
Figure 3C:
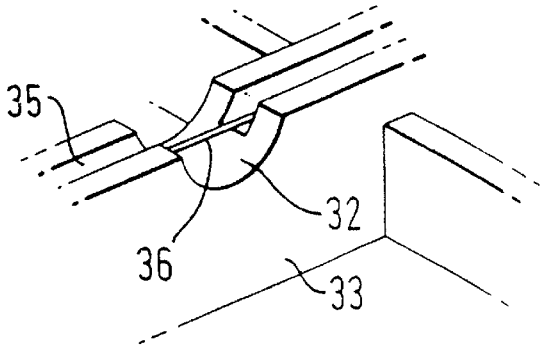

The axles 64 are supported by the grid 10. In particular, each of the second set of internal walls 13 of the grid 10 has a through hole 14 adjacent the center of the apertures 11, as shown in FIG. 2C and in phantom in FIG. 2A for one row of apertures 11. The axles 64 pass through respective through holes 14 in internal walls 13 of the grid 10 and thereby support the playing pieces 60 in the grid apertures 11. The internal walls 13 have an inverted L-shape cross-sectional shape.

The carriage 30 comprises a square frame having four side walls 31. One of the side walls 31' has eight semi-circular recesses 32 provided in its uppermost edge. The carriage 30 further has seven internal walls 33 which are parallel to the recessed side wall 31' and evenly spaced across the carriage 30. Each of the internal side walls 33 has semi-circular recesses 32 in their uppermost edges corresponding to the semi-circular recesses 32 of the recessed side wall 31' of the carriage 30. Each of the internal walls 33 and the recessed side wall 31' of the carriage 30 has a narrow groove or channel 35 running along its length, the channels 35 being interrupted only by the semi-circular recesses 32. A steel spring wire 36 is located in each of the grooves 35.

In the assembled game apparatus 1, the internal walls 33 of the carriage 30 are received in the L-shape of the corresponding internal walls 13 of the grid 10 so that the axles 64 carrying the playing pieces 60 are received in the semi-circular recesses 32 of the carriage 30. The spring wires 36 therefore engage the respective triangular studs 69 of the playing pieces 60. As can be seen from FIG. 7, the orientation of each triangular stud 69 is rotated through 60° relative to the orientation of the triangular end face 62 of the playing piece 60 so that an apex 71 of the triangular stud 69 is nearest to a face 61 of the playing piece 60 and, correspondingly, a face 72 of the triangular stud 69 is opposite an apex 73 of the triangular end face 62 of the playing piece 60. The depth of each recess 32 and channel 35 in the carriage 30 is arranged so that the spring wires 36 are biased upwardly against the triangular studs 69 of the playing pieces 60 in the assembled game apparatus 1. In the orientation shown in FIG. 6, in which a face 61 of the playing piece 60 is presented uppermost through the aperture 11 of the grid 10, the spring wire 36 bears against the opposite face 72 of the triangular stud 69 and maintains the playing piece 60 in that orientation. The spring wire 36 is pushed downwards by the apex 71 of the triangular stud 69 as the playing piece 61 is rotated about the axle 64. As the next face 61 of the playing piece 60 begins to be presented uppermost in the aperture 11 and the apex 71 contacting the spring wire 36 moves past its lowermost position, the upwards bias of the spring wire 36 forces the playing piece 60 round until the spring wire 36 bears against a flat face 72 of the triangular stud 69 so that the next face 61 is presented uppermost in the grid 10. The spring wire 36 thereby provides a detent mechanism which serves to maintain the playing pieces 60 in the selected orientation with the desired indicium (whether a large white circle 65, a large black circle 66, or a plain face 61) uppermost.

Figure 4:
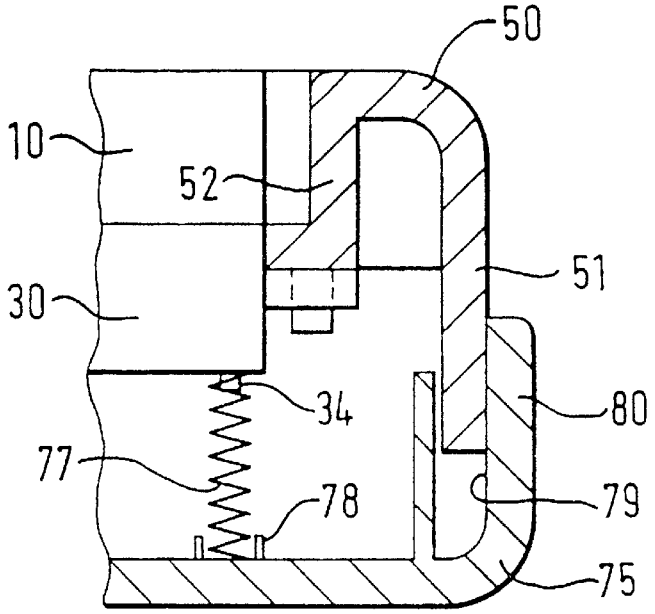
FIG. 4 is a partial cross-sectional view of the game apparatus of FIG. 1.
Figure 5:
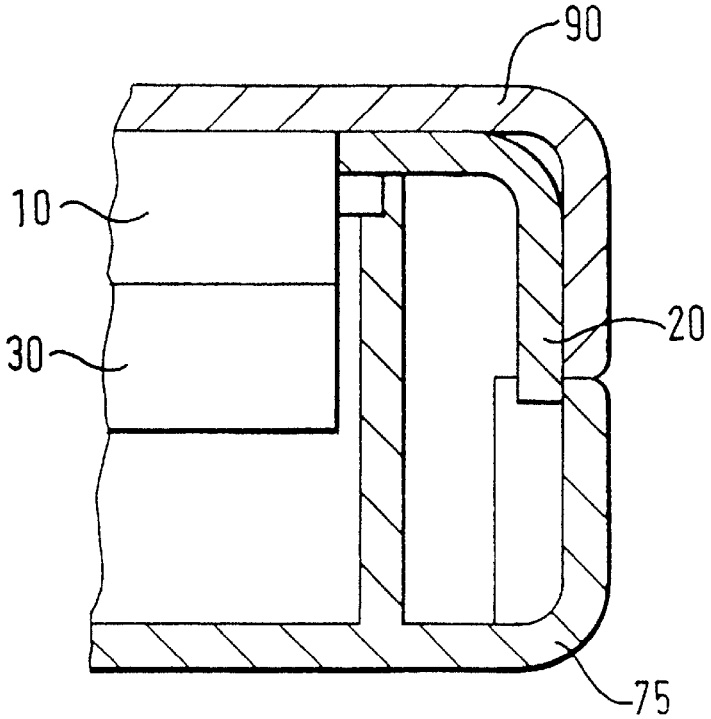
FIG. 5 is a further partial cross-sectional view of the game apparatus of FIG. 1.

As indicated in FIG. 1 and shown more particularly in FIGS. 4 and 5, a bottom cover 75 is secured to the frame 20 by fixing screws 76 to trap the grid 10 and carriage 30 therebetween, the grid 10 being presented through a central square aperture 21 of the frame 20. The carriage 30 is supported on the bottom cover 75 by means of coiled compression springs 77. One end of each of the springs 77 is received in respective hollow circular posts 78 provided internally of the bottom cover 75. The other end of each of the springs 77 fits round respective legs 34 which depend from each corner of the lowermost surface of the carriage 30. The carriage 30 is biased upwards by the coiled compression springs 77.

A pair of opposed reset buttons 50 are provided to allow the carriage 30 to be pushed downwards towards the bottom cover 75 against the action of the compression springs 77. As will be explained further below, this causes reset of the playing pieces 60 so that the plain faces 61 of all of the playing pieces 60 are presented uppermost. The reset buttons 50 have a generally inverted J-shape. The long leg 51 of each reset button 50 is received in a respective recess 79 provided in opposite edges 80 of the bottom cover 75 and can move up and down therein. The short leg 52 of each operating button 50 is secured to an adjacent edge of the carriage 30. Recesses 25 are provided in the corresponding edges of the frame 20 to accommodate the operating buttons 50.

Figure 6:
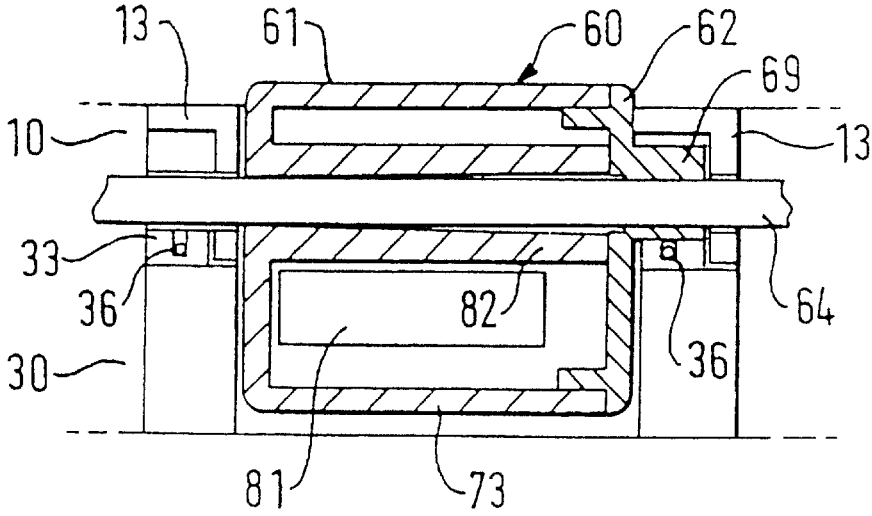
FIG. 6 is a partial cross-sectional view of the game apparatus of FIG. 1 showing a cross-section of a playing piece.
Figure 7:
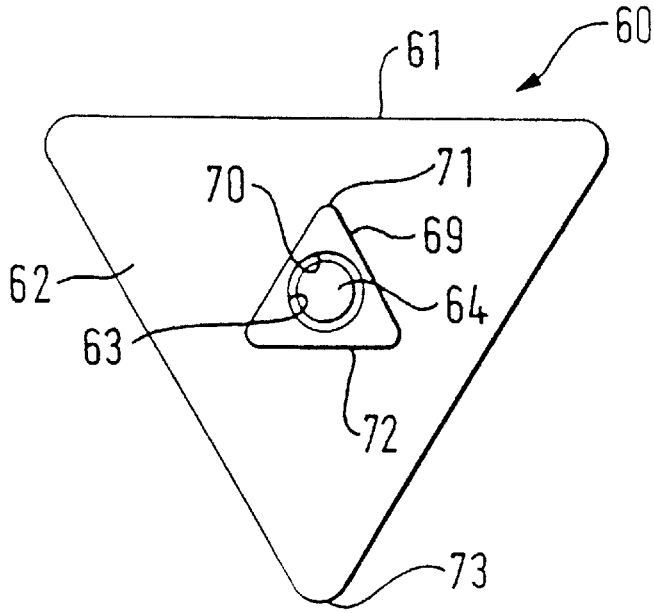
FIG. 7 is an end view of a playing piece.

Each playing piece 60 contains a weight 81 within its hollow center as shown in FIG. 6. The weight 81 is contained towards the apex 73 of the playing piece 60 which is opposite the plain face 61 which bears no major indicium. The weight 81 may be contained by internal moulding 82 of the playing piece 60. One end wall 62 of the playing piece 60 may be removable so as to provide access to the interior of the playing piece 60 to allow the weight 81 to be inserted. The weight 81, which may be a metal cylinder or several ball bearings for example, serves to bias the playing piece 60 under gravity to the orientation in which the plain face 61 is presented uppermost.

To reset the playing pieces 60 prior to playing a new game, the operating buttons 50 are depressed and move downwards in the recesses 79 in the bottom cover 75. This pushes the carriage 30 downwards against the action of the compression springs 77, thereby pulling the spring wires 36 away from engagement with the triangular studs 71. The playing pieces 60 are therefore all able to rotate freely about their respective axles 64. Under the action of the weights 81, the playing pieces 60 rotate so that the plain faces 61 bearing no major indicium all face uppermost in the grid 10. The reset buttons 50 are then released, allowing the compression springs 77 to force the carriage 30 upwards to bring the spring wires 36 into engagement with the faces 72 of the triangular studs 69 thereby to maintain that orientation of the playing pieces 60.

The present invention therefore provides game apparatus 1 in which there are no loose playing pieces. On the contrary, the playing pieces 60 are held captive in the game apparatus 1. The playing pieces 60 are rotated to present uppermost a desired indicium or no indicium at all, selectively indicating for example the presence of a black counter, a white counter or no counter at the particular playing location at which that playing piece 60 is located. The present invention provides a retaining or detent mechanism which serves to maintain the playing pieces 60 in their selected orientation. A simple reset mechanism is provided by means of which all of the playing pieces 60 can easily be reset to present, for example, the plain faces uppermost. The game apparatus 1 is particularly suitable for use in transit as a travel game. The retaining or detent mechanism serves to maintain the playing pieces 60 in their chosen orientation, regardless of whether the game apparatus 1 is tilted or jolted.

In the example shown, a top cover 90 is provided to cover over the frame 20, grid 10 and playing pieces 60 when the game apparatus 1 is not in use. In the example shown, the top cover 90 is hinged to the bottom cover 75 by means of hinges 91. Alternatively, the top cover 90 may be provided as a separate piece which can be snapped onto the remainder of the game apparatus 1.

As playing a game such as Othello with eight-by-eight playing pieces/locations may be too complex for younger children, a square border may be applied to the game apparatus 1 so as to cover the outermost playing pieces 60 thereby leaving the central array of six-by-six playing locations/pieces for play by younger children.

An embodiment of the present invention has been described with particular reference to the example illustrated. However, it will be appreciated that variations and modifications may be made to the example described within the scope of the present invention. For example, more or less than two indicia 65,66 in addition to a blank face may be provided on the playing pieces 60. As another example, the playing pieces 60 may have more or less than the three faces 61, the stud 64 being correspondingly shaped.

I claim:

1. Game apparatus, the game apparatus comprising:

a plurality of playing locations at each of which is rotatably mounted a playing piece, each playing piece having an indicium thereon so that rotation of a playing piece to a selected orientation presents said indicium to a player;

retaining means for retaining each playing piece in a selected orientation, wherein the retaining means comprises at least one elastic member biased into engagement with the playing pieces; and, reset means operable to reset the playing pieces for a new game by disengaging said at least one elastic member from the playing pieces, thereby allowing the playing pieces to be reset.

2. Game apparatus according to claim 1, wherein the center of mass of each playing piece is offset from its axis of rotation, the reset means being operable to release the retaining means from retaining the playing pieces to allow the playing pieces to rotate under gravity and thereby reset the playing pieces.

3. Game apparatus according to claim 1, wherein each playing piece has a plurality of faces, at least one of said faces having an indicium thereon to distinguish that face from other faces of the playing piece.

4. Game apparatus according to claim 3, wherein each playing piece includes at least one rotation indicium thereon, said rotation indicium being smaller than the first indicium.

5. Game apparatus according to claim 4, wherein each face having an indicium thereon also includes at least one rotation indicium thereon.

6. Game apparatus according to claim 5, wherein each face having an indicium thereon also includes plural rotation indicium thereon.

7. Game apparatus according to claim 3, wherein each playing piece includes at least one rotation indicium thereon, each of said rotation indicium being adapted to indicate to a player the direction of rotation of the playing piece about its axis of rotation to display a corresponding one of the faces.

8. Game apparatus according to claim 3, wherein each face having an indicium theron also includes at least one rotation indicium thereon.

9. Game apparatus according to claim 1, wherein said at least one elastic member comprises plural spring wires which are biased into engagement with respective ones of said playing pieces.

10. Game apparatus according to claim 9, wherein each playing piece has an abutment, the spring wires engaging the abutments of the respective playing pieces to retain the playing pieces in a selected orientation.

11. Game apparatus according to claim 1, wherein the retaining means are carried by a carriage which is displaceable to allow the playing pieces to be reset.

12. Game apparatus according to claim 11, comprising biasing means for biasing the carriage so that the playing pieces are normally retained in a selected orientation by the retaining means, the carriage being displaceable against the bias of the biasing means to allow the playing pieces to be reset.

13. Game apparatus according to claim 12, wherein the carriage is adapted to be displaced downward from the playing pieces.

14. Game apparatus according to claim 1, comprising a lattice grid having a plurality of walls defining the plurality of playing locations and supporting the playing pieces.

15. Game apparatus according to claim 14, wherein the playing pieces are rotatably mounted on respective axles supported by the grid.

16. Game apparatus according to claim 1, wherein each playing piece is captively mounted in said apparatus.

17. Game apparatus according to claim 1, wherein each playing piece is a triangular prism having three faces selectively presentable to a player by rotation of the playing piece.

18. Game apparatus according to claim 17, wherein a first face of each playing piece has a first indicium thereon indicating a first game counter and a second face of each playing piece has a second indicium thereon indicating a second counter.

19. Game apparatus according to claim 18, wherein the face of each playing piece bears an indicium indicating the direction of rotation of the playing piece required to present a desired first or second indicium to a player.

20. Game apparatus, the game apparatus comprising:

a plurality of playing locations at each of which is rotatably mounted a playing piece, each playing piece having a plurality of faces, at least one of said faces of each playing piece having an indicium thereon to distinguish that face from other faces of the playing piece so that rotation of a playing piece to a selected orientation presents said indicium to a player;

a carriage carrying plural spring wires which are biased into engagement with respective ones of said playing pieces for retaining each playing piece in a selected orientation; and, biasing means for biasing the carriage so that the playing pieces are normally retained in the selected orientation by the spring wires, the carriage being displaceable against the bias of the biasing means to disengage the spring wires from the playing pieces thereby to allow the playing pieces to be reset for a new game.

21. Game apparatus according to claim 20, wherein the center of mass of each playing piece is offset from its axis of rotation in a direction opposite a predetermined face of said playing piece, the playing pieces rotating under gravity to present said predetermined faces to a player thereby to reset the playing pieces when the spring wires are disengaged from the playing pieces.

22. Games apparatus of claim 20, wherein each playing piece includes at least one rotation indicium thereon adapted to indicate to a player the direction of rotation of the playing piece about its axis of rotation to display a corresponding one of the faces.

23. Game apparatus according to claim 22, wherein each face having an indicium thereon also includes at least one rotation indicium thereon.

24. Game apparatus according to claim 20, comprising a lattice grid having a plurality of walls defining the plurality of playing locations and supporting the playing pieces.

25. Game apparatus according to claim 24, wherein the playing pieces are rotatably mounted on respective axles supported by the grid.

26. Game apparatus according to claim 20, wherein each playing piece is captively mounted in said apparatus.

27. Game apparatus, comprising:

a base including a depressible carriage;

at least one mechanism adapted to bias the carriage away from the base;

a plurality of rotatable playing pieces having axes of rotation, each playing piece including a plurality of faces that are selectively revealable to a player by rotating the playing pieces about their axes of rotation;

indicium on at least one of the faces of each playing piece; and at least one second bias mechanism normally adapted to engage the plurality of playing pieces to prevent unintentional rotation of the playing pieces, wherein upon depression of the carriage toward the base, the playing pieces are freed from engagement by the at least one second bias mechanism.

28. Game apparatus of claim 27, wherein each of the plurality of playing pieces has a center of mass offset from its axis of rotation, thereby biasing the playing pieces to rotate under gravity to a determined orientation when the carriage is depressed toward the base.

29. Game apparatus of claim 27, wherein each of the plurality of playing pieces includes a least one first indicium on a first face and at least one second indicium on a second face.

30. Game apparatus of claim 29, wherein each of the plurality of playing pieces further includes rotation indicium adapted to indicate to a player the direction of rotation of the playing piece to reveal a corresponding one of the plurality of faces.

31. Game apparatus, the game apparatus comprising:

a plurality of playing locations at each of which is rotatably mounted a playing piece, each playing piece having a plurality of faces, wherein at least one of said faces has an indicium thereon so that rotation of a playing piece to a selected orientation presents said indicium to a player, and further wherein each face having an indicium thereon also includes at least one rotation indicium thereon adapted to indicate to a player the direction of rotation of the playing piece about its axis of rotation to display a corresponding one of the faces;

retaining means for retaining each playing piece in a selected orientation; and, reset means operable to reset the playing pieces for a new game.

32. Game apparatus according to claim 31, wherein the center of mass of each playing piece is offset from its axis of rotation, the reset means being operable to release the retaining means from retaining the playing pieces to allow the playing pieces to rotate under gravity and thereby reset the playing pieces.

33. Game apparatus according to claim 31, wherein each face having an indicium thereon also includes plural rotation indicium thereon.

34. Game apparatus according to claim 31, wherein the retaining means are carried by a carriage which is displaceable to allow the playing pieces to be reset.

35. Game apparatus according to claim 35, comprising biasing means for biasing the carriage so that the playing pieces are normally retained in a selected orientation by the retaining means, the carriage being displaceable against the bias of the biasing means to allow the playing pieces to be reset.

36. Game apparatus according to claim 34, wherein the carriage is adapted to be displaced downward from the playing pieces.

37. Game apparatus according to claim 31, comprising a lattice grid having a plurality of walls defining the plurality of playing locations and supporting the playing pieces.

38. Game apparatus according to claim 37, wherein the playing pieces are rotatably mounted on respective axles supported by the grid.

39. Game apparatus according to claim 31, wherein each playing piece is captively mounted in said apparatus.

* * * * *